United States Patent [19]

Dold

[11] 4,082,384

[45] Apr. 4, 1978

[54] CASKET CANOPY

[76] Inventor: Anthony A. Dold, Richmond, Minn. 56368

[21] Appl. No.: 706,352

[22] Filed: Jul. 19, 1976

[51] Int. Cl.[2] ..... A47B 81/00

[52] U.S. Cl. ..... 312/3; 27/1; 312/278

[58] Field of Search ..... 312/3, 5, 198, 250, 312/278, 279; 27/1; 108/92; 135/5 R; 160/19, 351; 211/180; 258/27.8

[56] References Cited

U.S. PATENT DOCUMENTS

| | | | |
|---|---|---|---|
| 1,559,221 | 10/1925 | Carpenter | 248/27.8 |
| 1,706,240 | 3/1929 | Liley | 312/278 X |
| 1,871,611 | 8/1932 | Headland | 135/5 R |
| 1,949,326 | 2/1934 | Peterson | 312/198 X |
| 2,271,003 | 1/1942 | Franseen | 312/278 X |
| 2,303,725 | 12/1942 | De Ment | 160/19 |
| 2,491,755 | 12/1949 | Muench | 211/180 X |

*Primary Examiner*—Paul R. Gilliam
*Assistant Examiner*—David H. Corbin
*Attorney, Agent, or Firm*—Jones, Tullar & Cooper

[57] ABSTRACT

A casket canopy assembly for use in providing a backdrop and display assembly for use with a casket is disclosed. A pair of end wing units having tiered shelves cooperate with a top unit, which may be separable from or secured to the wing units, to provide an assembly having a top and sides within which a casket may be placed either during a funeral or for display purposes. A suitable drape or curtain may be suspended from the assembly and a light fixture may be positioned on the wing units with the shelves providing suitable supports for floral displays and the like.

6 Claims, 3 Drawing Figures

CASKET CANOPY

FIELD OF THE INVENTION

The present invention is directed to a display canopy or enclosure for use with a generally elongated object such as a casket. More particularly, the present invention is directed to such a display canopy which is portable from one area to another. Even more particularly, the present invention is directed to a casket canopy which is capable of being disassembled into several component parts for ease in transport and storage. Most specifically, the present invention is directed to a casket canopy assembly having opposed wing units each of which is provided with tiered shelves and which either each carry a portion of a top or which together support a separate top.

The casket canopy in accordance with the present invention includes two end wing units which are provided with tiered shelves and which are supported by suitable casters or the like so that these units can be moved from place to place. Each wing unit may have secured thereto one half of a top portion or both wings may cooperate to support a removable top unit. The casket canopy assembly may include suitable drapes and is intended to provide a backdrop and side assembly within which a casket can be positioned.

DESCRIPTION OF THE PRIOR ART

It has long been recognized in the art that it is desirable to provide a canopy or display assembly for use with a casket. This type of structure may be used either during funerals themselves or may be used by a funeral home operator or casket manufacturer to display caskets. These display fixtures usually surround the casket to a greater or lesser extent and are intended to soften the visual impact of the casket. One example of the prior art is U.S. Pat. No. 1,662,522 to Laube in which there is shown a portable funeral canopy and stand which is adapted to surround and display a casket. While this patent shows the general concept of a portable display device for use with a casket, it is not as well suited for its task as is the apparatus of the subject invention.

A funeral home may have various rooms in which funerals are conducted and it is desirable that the canopy not only be portable but also be capable of being disassembled for ease in transport from room to room and also from the funeral home to, for example, a church. While the prior art casket canopy assemblies are portable, they are not easily and quickly disassembled.

Floral displays are quite often utilized in funeral services and it is often desired to place such displays about the casket in an attractive and tasteful manner. While there are any number of stands and racks in the prior art which will support baskets or vases of flowers, there are none known to applicant which are structured as a portion of a casket canopy assembly. This lack of such a structure makes the task of arranging floral displays about a casket more difficult.

It is also known in the art to provide illuminating devices for use with caskets. This may be seen in U.S. Pat. No. 1,871,611 to Headland. It is further known to provide drape supporting devices for caskets, such as seen in U.S. Pat. No. 2,303,725 to DeMent. Further, a combination drape and light assembly for use in funeral decoration is shown in U.S. Pat. No. 567,405 to Garland. However, these prior art patents are somewhat cumbersome affairs and further are not capable of providing a support means for floral displays and the like. In addition, these several prior art devices are not particularly stable and could possibly collapse or come apart during use.

SUMMARY OF THE INVENTION

It is accordingly an object of the present invention to provide a casket canopy assembly which is portable and easily disassembled.

It is a further object of the present invention to provide a casket canopy which includes shelves for use in supporting floral arrangements and the like.

Yet another object of the present invention is to provide a casket canopy which is a stable structure and which includes a light assembly and means for supporting a suitable drape or curtain.

The casket canopy or display assembly in accordance with the present invention includes two end wing units which are mirror images of each other and which both carry a tiered array of shelves. A separate top is securable to an upper portion of the two end wings and is supported thereby. In an alternate arrangement, the top is formed in two sections with one section being affixed to each end wing unit. This canopy assembly is thus not only portable, since each wing is supplied with caster wheels or the like, but further is capable of being quickly disassembled and transported from one room to another or from one building to another.

The two end wing units are each generally in the shape of a right triangle with the shelves extending up the hypotense and with the top being secured at the point of the triangle. This arrangement provides a stable structure for the support of the various floral displays, drapes, curtains, light fixtures and the like which may be utilized either during a funeral or in displaying a casket to a prospective purchaser. The present invention thus provides a casket canopy assembly which is much more secure and stable than the prior art devices.

The casket canopy device of the present invention also includes a light means and a means to support a drape or curtains, if desired. As discussed above, these features are known generally in the art but in the past such devices were often either attached directly to the casket itself or were somewhat makeshift arrangements. In the present invention, the light means, drape or curtain support, top portion and tiered, shelved, end wings are all easily assembled into a stable, complete unit which does not run the risk of collapse at an inopportune moment. In addition, as has been discussed above, this entire assembly can be easily transported from place to place and provides a much superior casket canopy assembly over those shown in the prior art.

BRIEF DESCRIPTION OF THE DRAWINGS

While the patentably novel features of the subject invention are set forth with particularity in the appended claims, a full and complete understanding of the invention will be had by referring to the description of the preferred embodiments as is set forth hereinafter and as may be seen in the accompanying drawings in which:

DESCRIPTION OF A PREFERRED EMBODIMENT

Figure 1:
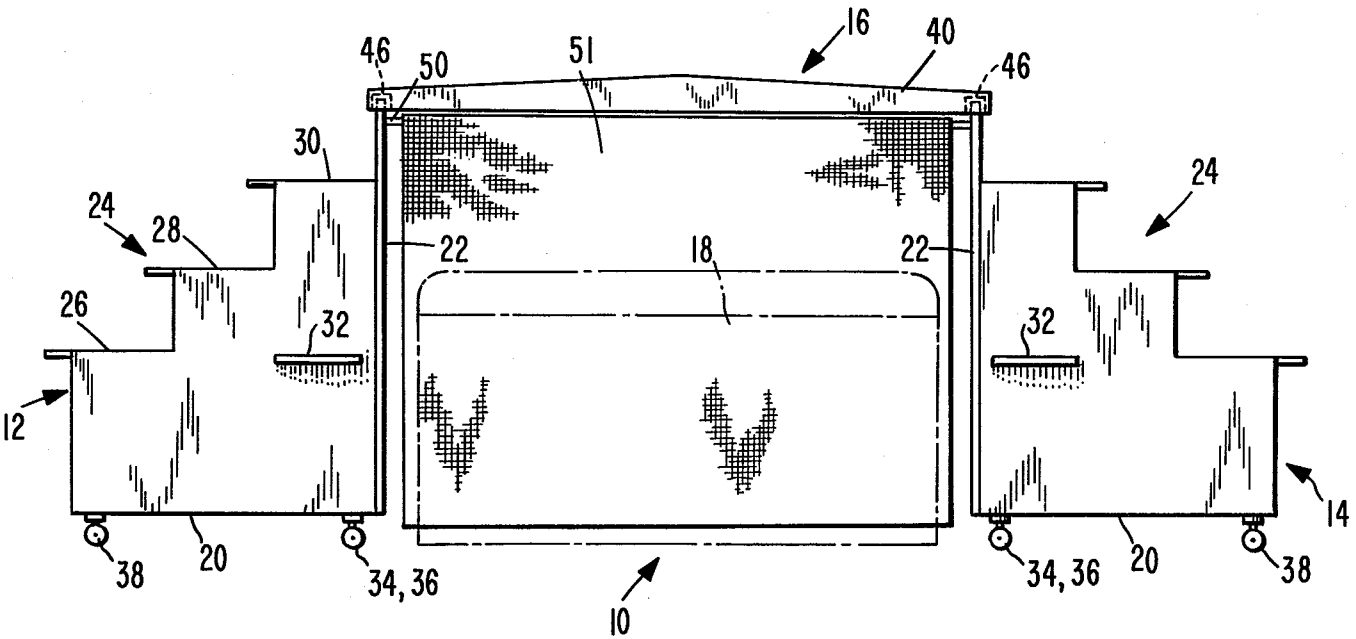
FIG. 1 is a front elevation view of a preferred embodiment of a casket canopy in accordance with the present invention.

Turning now to FIG. 1, there may be seen generally at 10, a preferred embodiment of a casket canopy or display assembly in accordance with the present invention. This casket canopy or display assembly is comprised generally of left and right end wing sections 12 and 14 respectively, and a removable top or cover assembly 16. In the preferred embodiment the wing sections 12 and 14 and the top 16 are made primarily of wood which may be of any desired type and may be stained, painted or otherwise covered as desired. It will, of course, be obvious to one of ordinary skill in the art that other materials such as metal or plastic could be utilized in the construction of the assembly 10. As may be seen in FIG. 1, the end wing sections 12 and 14 and the top 16 combine to form a canopy for a casket 18 shown generally in phantom.

Figure 2:
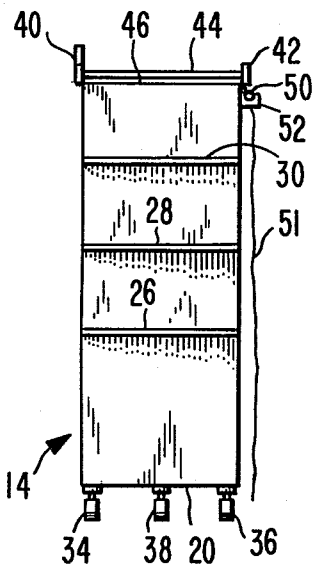
FIG. 2 is a side elevation view of the casket canopy of FIG. 1.

As may be seen in FIGS. 1 and 2, each of the end wing units 12 and 14 is generally triangular in the preferred embodiment and has a generally horizontal base 20, a generally vertical inner wall 22, and an outer tiered wall 24. Outer tiered wall 24 is, in the preferred embodiment, divided into three tiers or shelves 26, 28 and 30 with these shelves being generally horizontal and each of the same general size. In addition, each end wing may also have one or more pull out shelves such as is shown at 32 in FIG. 1. The location and number of the pull out shelves may vary as desired. Each end unit 12 and 14 is supported by at least three spaced caster wheels 34, 36, 38 with, as may be seen in FIG. 2, there being provided two casters 34 and 36 spaced at the corners of the intersection of the base 20 and the inner wall 22 and with the third caster 38 located at the opposite end of base 22 and at the midpoint of that end. In this way the three casters provide triangular support for each end wing unit 12 and 14 while allowing maneuverability of these units. Should it be desired or necessary to increase the number or size of the caster units, this can easily be accomplished.

Top or cover 16 is, as may be seen in FIGS. 1 and 2, a generally elongated rectangular member having a front vertical face 40, a smaller rear vertical face 42, and generally horizontal web 44 therebetween. As may be seen in FIG. 1, front vertical face 40 may be generally pyramid shaped or may be arched and may carry suitable decorative inscriptions, carvings, scroll work or the like as may be desired. The horizontal web is, as may be seen in FIG. 2, as wide as the inner wall 22 of the wing units and the vertical faces 40 and 42 cooperate with the web 44 to prevent the end wing units from shifting transversely. Top or cover 16 is also provided at its ends with suitable means to engage the upper ends of the inner walls 22 of the wing units 12 and 14 to prevent movement of these end units toward or away for each other. One means for accomplishing this is through the use of suitable inverted U shaped channels 46 secured to either end of web 44. These inverted channels engage the upper ends of the inner wall 22 of wing units 12 and 14 and thus secure cover 16 in place. It will be obvious that any number of alternative fastening or supporting systems could be utilized so long as they are capable of securely yet releasably joining the top 16 and end units 12 and 14 together.

It is often desirable to provide a curtain or drape to act as a backdrop for the casket and accordingly, the casket canopy of the present invention may include a removable drape rod 50 upon which may be supported a drape 51. Drape rod 50 is shown in FIGS. 1 and 2 as being supported by rod brackets 52 which are attached to the back of inner walls 22 of the end wing units 12 and 14. This means for attaching drape 51 is exemplary of a number of similar means for accomplishing this result. For example, hooks could be attached to the rear vertical face 42 of top 16 or, as another alternative, a rod could be secured to either the rear face 42 or to the web 44. Again, any suitable means could be used so long as it does not interfere with the portability and ease of disassembly of the casket canopy 10. Similarly, a light fixture or fixtures of known configuration can be attached to the top and/or wing units so long as these do not hinder the assembly and disassembly of the casket canopy.

In use, the two end wing units 12 and 14 are wheeled into place at either end of a casket and the top 16 is then set into place with its channels 46 engaging the upper ends of inner walls 22 of the wing units. A suitable drape 51 is then put in place and, if desired, a cloth or similar cover is placed over the wing units. Floral displays and the like can be positioned on the shelves 26, 28, 30 and 32 and the light means (not shown) actuated. When it is necessary to move the assembly, the cover and drape are removed, top 16 is disengaged from end wing units 12 and 14, and they are now free to be wheeled wherever needed. They can, if necessary, be stored such as by inverting one unit and placing it on the other so that the top shelf 30 of the inverted unit rests on the bottom shelf 26 of the remaining unit. Top 16 can easily be carried from place to place. In the preferred embodiment of FIGS. 1 and 2, each end wing is approximately 5 feet, 8 inches high and 2 feet deep with each shelf having a length of 16 inches for a total length of each wing unit of 4 feet. The top is 8 feet in length and 2 feet wide so that it and the end wing units, when assembled, form a structure 16 feet in length and 2 feet wide.

Figure 3:
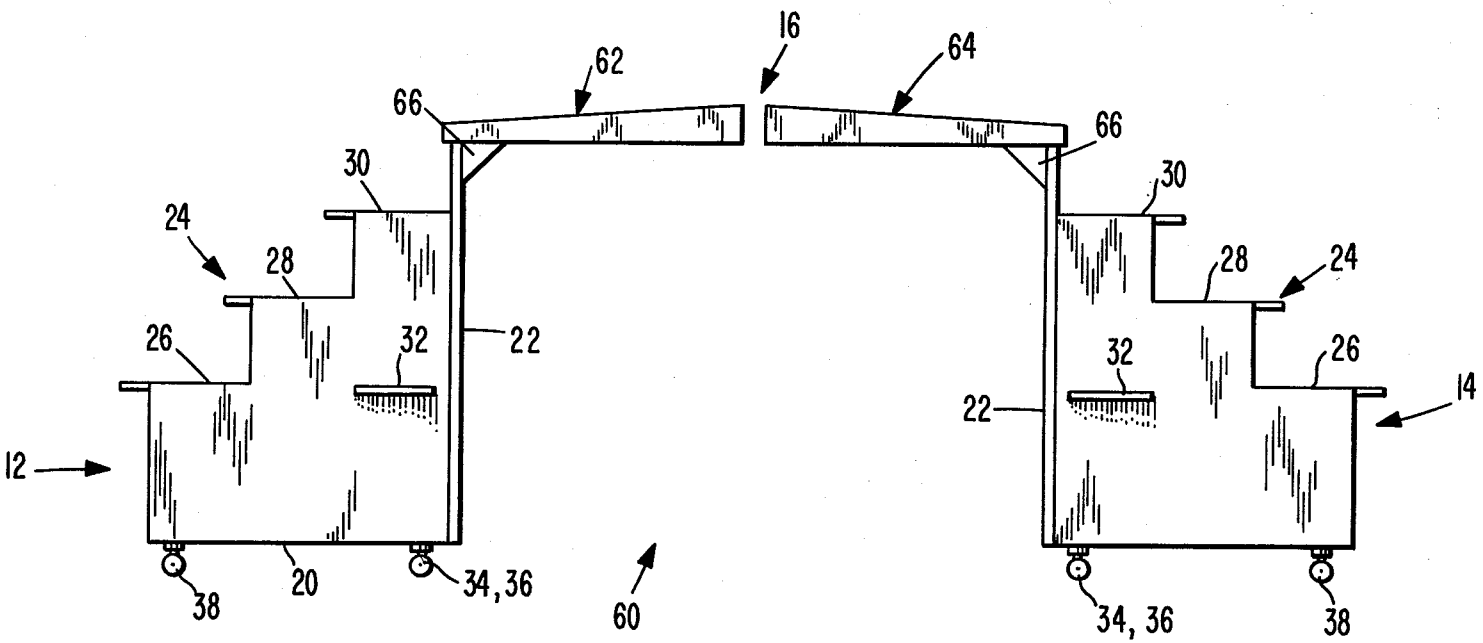
FIG. 3 is a front elevation view of an alternate embodiment of a casket canopy in accordance with the present invention.

Turning now to FIG. 3, there may be seen generally at 60 an alternate embodiment of a casket canopy in accordance with the present invention. At this embodiment in which similar numbers designate portions corresponding to the first embodiment 10, the end wing units 12 and 14 are virtually identical to those in the first embodiment 10 so that they need not be discussed further. The top 16 of the casket canopy assembly 60 of FIG. 3 is somewhat different in that it is comprised of two halves 62 and 64 which are each rigidly affixed to end units 12 and 14 respectively. If desired, corner brace 66 can be utilized at the juncture of the top halves 62 and 64 with the inner walls 22 of end units 12 and 14 to provide added support. The embodiment shown in FIG. 3 is preferred where it is desired to be able to adjust the spacing between the end units since the two top halves do not necessarily have to abut each other. It may also be desirable to place the canopy assembly in such a manner that the end units are either offset or angled slightly from each other. Again, the embodiment of FIG. 3 provides for this. It will be understood that the casket canopy assembly 60 may be provided with similar drape affixing means, lighting fixtures and the like as is assembly 10 with the difference between canopy units 10 and 60 residing in the structure of the top 16 and the attachment to end wing units 12 and 14 there being shown a one piece removable top in FIG. 1 and a two piece fixedly secured top in FIG. 3.

While preferred embodiments of a casket canopy assembly in accordance with the present invention have been set forth hereinabove fully and completely, it will be obvious to one of ordinary skill in the art that a number of changes in, for example, the dimensions of the units, the number of tiers of shelves, the positioning of the pull out shelves, the type of material used and the like may be made without departing from the true spirit of the invention and that therefore the scope of the invention is to be limited only by the following claims.

I claim:

1. A casket canopy assembly for use in forming a backdrop for a casket to be displayed and for providing support surfaces for decorations to be placed about the casket, said casket canopy assembly comprising:

first and second spaced end wing units, each of said end wing units including a vertical inner wall and a tiered outer wall, each said tiered wall having a plurality of horizontal support shelves extending outwardly from said tiered wall perpendicularly to said inner wall, each said inner wall including an upper portion extending above an uppermost one of said horizontal shelves, each of said end wing units further including casters secured to a base portion thereof; and a horizontal, elongated top, said top including first and second top halves, a first end of each of said top halves being secured to said upper portion of said vertical inner wall of one of said end wing units, said top halves extending perpendicularly inwardly from said vertical inner walls of said end wing units and having second end portions adjacent each other when said casket canopy assembly is in use, said vertical inner walls and said horizontal top halves cooperating to form an enclosure within which the casket is placed during use of said casket canopy assembly, said spaced end wing units being positioned at opposed ends of said casket with said vertical inner walls being parallel to each other and to the ends of said casket.

2. The assembly of claim 1 wherein each of said end wing units further includes at least one pull out shelf.

3. The assembly of claim 1 wherein said casket canopy assembly further includes means for supporting a drape between said end units when said assembly is positioned about the casket.

4. A casket canopy assembly for use in forming a backdrop for a casket to be displayed and for providing support surfaces for decorations to be placed about the casket, said casket canopy assembly comprising:

first and second spaced end wing units, each of said end wing units including a vertical inner wall and a tiered outer wall, each said tiered wall having a plurality of horizontal support shelves extending outwardly from said tiered wall perpendicularly to said inner wall, each said inner wall including an upper portion extending above an uppermost one of said horizontal shelves, each of said end wing units further including casters secured to a base portion thereof; and a horizontal, elongated top, said top including first and second ends, each of said ends including a transverse, inverted U-shaped channel, said upper portions of said vertical inner walls of said first and second spaced end wing units being engaged in said channels of said top, said top extending between said end wing units and perpendicularly thereto, and cooperating with said vertical inner walls of said end wing units to form an enclosure within which the casket is placed during use of said casket canopy assembly, said spaced end wing units being positioned at opposed ends of said casket with said vertical inner walls being parallel to each other and to the ends of said casket.

5. The assembly of claim 4 wherein each of said end wing units further includes at least one pull out shelf.

6. The assembly of claim 4 wherein said casket canopy assembly further includes means for supporting a drape between said end units when said assembly is positioned about the casket.

* * * * *